US011031720B2

(12) United States Patent
Miyamura et al.

(10) Patent No.: US 11,031,720 B2
(45) Date of Patent: Jun. 8, 2021

(54) CONNECTOR WITH TERMINAL FITTING

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tetsuya Miyamura, Mie (JP); Masaaki Tabata, Mie (JP); Hajime Matsui, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 94 days.

(21) Appl. No.: 16/494,348

(22) PCT Filed: Feb. 23, 2018

(86) PCT No.: PCT/JP2018/006704
§ 371 (c)(1),
(2) Date: Sep. 16, 2019

(87) PCT Pub. No.: WO2018/168401
PCT Pub. Date: Sep. 20, 2018

(65) Prior Publication Data

US 2020/0091647 A1 Mar. 19, 2020

(30) Foreign Application Priority Data

Mar. 15, 2017 (JP) ..... JP2017-049446

(51) Int. Cl.
*H01R 9/03* (2006.01)
*H01R 13/44* (2006.01)
(Continued)

(52) U.S. Cl.
CPC ..... *H01R 13/447* (2013.01); *H01R 13/502* (2013.01)

(58) Field of Classification Search
CPC .. H01R 13/4538; H01R 13/502; H01R 13/44; H01R 13/631; H01R 13/658; H01R 13/4532; H01R 13/3534; H01R 13/447
(Continued)

(56) References Cited

U.S. PATENT DOCUMENTS 6,435,732 B1 * 8/2002 Asao ..... G02B 6/387 385/78
7,740,492 B2 * 6/2010 Dei Rossi ..... H01R 13/60 439/131
(Continued)

FOREIGN PATENT DOCUMENTS

JP 5-65071 8/1993
JP 6-333629 12/1994
(Continued)

OTHER PUBLICATIONS

International Search Report of Apr. 17, 2018.

*Primary Examiner* — Abdullah A Riyami
*Assistant Examiner* — Thang H Nguyen
(74) *Attorney, Agent, or Firm* — Gerald E. Hespos; Michael J. Porco; Matthew T. Hespos

(57) ABSTRACT

A connector (10) includes a terminal supporting body (30) and a terminal covering body (50) slidable relative to each other. Male terminal fittings (20) are supported in the terminal supporting body (30), and each has a male tab (21). A housing (70) has an accommodating portion (71) to accommodate the terminal supporting body (30) and the terminal covering body (50), and a receptacle (72) surrounds the male tabs (21). The terminal covering body (50) slides between a protection position and an exposed position relative to the male tabs (21). The accommodating portion (71) has a contact stop (75) that stops the terminal covering body (50). The terminal supporting body (30) slides to displace the terminal covering body (50) from the protection
(Continued)

position to the exposed position when a sufficient force is applied with the terminal covering body (50) stopped in contact with the contact stop (75).

4 Claims, 16 Drawing Sheets

(51) Int. Cl.
*H01R 13/447* (2006.01)
*H01R 13/502* (2006.01)

(58) Field of Classification Search
USPC ..... 439/607.5, 607.41, 607.47–48, 140–141
See application file for complete search history.

(56) References Cited

U.S. PATENT DOCUMENTS 7,866,993 B2 * 1/2011 Ohsumi ..... H01R 12/721 439/141
7,950,934 B2 * 5/2011 Sallam ..... H01R 13/4534 439/135
8,231,401 B2 * 7/2012 Amano ..... H01R 13/6272 439/357
8,926,368 B2 * 1/2015 Il ..... H01R 13/6581 439/607.5
10,297,932 B2 * 5/2019 Maesoba ..... H01R 9/0518
10,770,838 B2 * 9/2020 Miyamura ..... H01R 13/6463
2009/0035976 A1 * 2/2009 Matsunaga ..... H01R 13/631 439/271
2011/0237098 A1 * 9/2011 Tajima ..... H01R 13/4538 439/140
2014/0206232 A1 * 7/2014 Kato ..... H01R 13/6592 439/607.5
2015/0031223 A1 * 1/2015 Liao ..... H01R 13/447 439/136
2018/0026401 A1 * 1/2018 Kanda ..... H01R 13/6473 439/607.5
2018/0138640 A1 * 5/2018 Maesoba ..... H01R 13/6581
2019/0326702 A1 * 10/2019 Miyamura ..... H01R 13/631
2020/0091648 A1 * 3/2020 Miyamura ..... H01R 13/4538
2020/0136310 A1 * 4/2020 Nishiyama ..... H01R 13/641
2020/0194937 A1 * 6/2020 Maesoba ..... H01R 13/20

FOREIGN PATENT DOCUMENTS

JP 8-111258 4/1996
JP 10-270115 10/1998
JP 2010-146843 1/2010

* cited by examiner

CONNECTOR WITH TERMINAL FITTING

BACKGROUND

Field of the Invention

The invention relates to a connector.

Related Art

Japanese Unexamined Patent Publication No. H06-333629 discloses a female connector and a male connector connectable to each other. The male connector includes a terminal supporting body supporting a male terminal and a main body for accommodating the terminal supporting body. The male terminal is formed such that a male tab projects forward. When the connectors are connected, the male tab is received into a female terminal to be connected electrically.

In accommodating the terminal supporting body into the main body, the male tab may interfere with an outer wall of the main body to be fractured or broken. In view of this, consideration has been given to assembling a protecting member with the terminal supporting body to cover and protect the male tab. However, such a configuration requires using a tool to remove the protecting member from the terminal supporting body to expose the male tab after the terminal supporting body is accommodated into the main body, thereby causing a problem of increasing working man-hours and complicating assembly.

The invention was completed on the basis of the above situation and aims to provide a connector capable of improving assembling workability.

SUMMARY

The invention relates to a connector with a terminal supporting body and a terminal covering body that are slidable relative to each other. A male terminal fitting is supported in the terminal supporting body and includes a projecting male tab. The connector also has a housing including an accommodating portion and a receptacle. The accommodating portion is configured to accommodate the terminal supporting body and the terminal covering body. The receptacle is connected to the accommodating portion and is configured to surround the male tab. The terminal covering body is relatively slidable between a protection position for covering the male tab and an exposed position for exposing the male tab. The accommodating portion is provided with a contact stop configured to stop the properly accommodated terminal covering body in contact therewith. The terminal supporting body relatively slides to displace the terminal covering body to the exposed position, is properly accommodated in the accommodating portion and locates the male tab in the receptacle when a force of a certain magnitude or higher is applied with the terminal covering body at the protection position stopped in contact with the contact stop.

A force of the certain magnitude or higher is applied to the terminal supporting body with the terminal supporting body and the terminal covering body inserted in the accommodating portion and with the terminal covering body at the protection position stopped in contact with the contact stop. This force causes the terminal supporting body relatively to slide and to displace the terminal covering body to the exposed position so that the male tab is arranged to be exposed in the receptacle. Thus, the male tab can be connected electrically to a mating female terminal fitting.

In a state before the terminal supporting body and the terminal covering body are accommodated into the accommodating portion, the male tab is protected by the terminal covering body at the protection position and the fracture or breakage of the male tab is avoided.

An operation of sliding the terminal supporting body and the terminal covering body is linked with an operation of accommodating the terminal supporting body and the terminal covering body into the accommodating portion, and these operations automatically displace the terminal covering body to the exposed position. Thus, a special tool for displacing the terminal covering body to the exposed position is unnecessary, working man-hours are not increased and assembling work is improved.

One of the terminal supporting body and the terminal covering body may be provided with a deflectable and deformable semi-locking portion, and the other may be provided with a restricting portion configured to be locked resiliently to the semi-locking portion at the protection position and to restrict a relative displacement of the terminal covering body to the exposed position unless a force of the certain magnitude or higher is applied to the terminal supporting body. According to this configuration, the terminal covering body is prevented from being displaced easily to the exposed position in the state before the terminal supporting body and the terminal covering body are accommodated into the accommodating portion.

The accommodating portion may be provided with a deflectable and deformable locking lance configured to retain and lock the properly accommodated terminal supporting body. According to this configuration, the terminal supporting body cannot escape from the accommodating portion. Further, the male terminal fitting is supported in the terminal supporting body locked by the locking lance. This supported and locked arrangement resists a pulling force that may be applied to a cable or wire that is connected to the male terminal fitting.

The accommodating portion may be provided with a hook that resiliently contacts the terminal covering body in a withdrawing direction, slides the terminal covering body to the protection position and allows the terminal covering body displaced to the protection position to be taken out when a force is applied to the terminal supporting body in the withdrawing direction. According to this configuration, if a force is applied to the terminal supporting body in the withdrawing direction when the terminal supporting body and the terminal covering body are taken out from the housing, the terminal covering body resiliently contacts the hook and is displaced to the protection position. The terminal supporting body and the terminal covering body then can be taken out from the housing. Thus, an operation of sliding the taken-out terminal supporting body and an operation of displacing the terminal covering body to the protection position need not be performed separately, and work efficiency can be improved.

DETAILED DESCRIPTION

Figure 1:
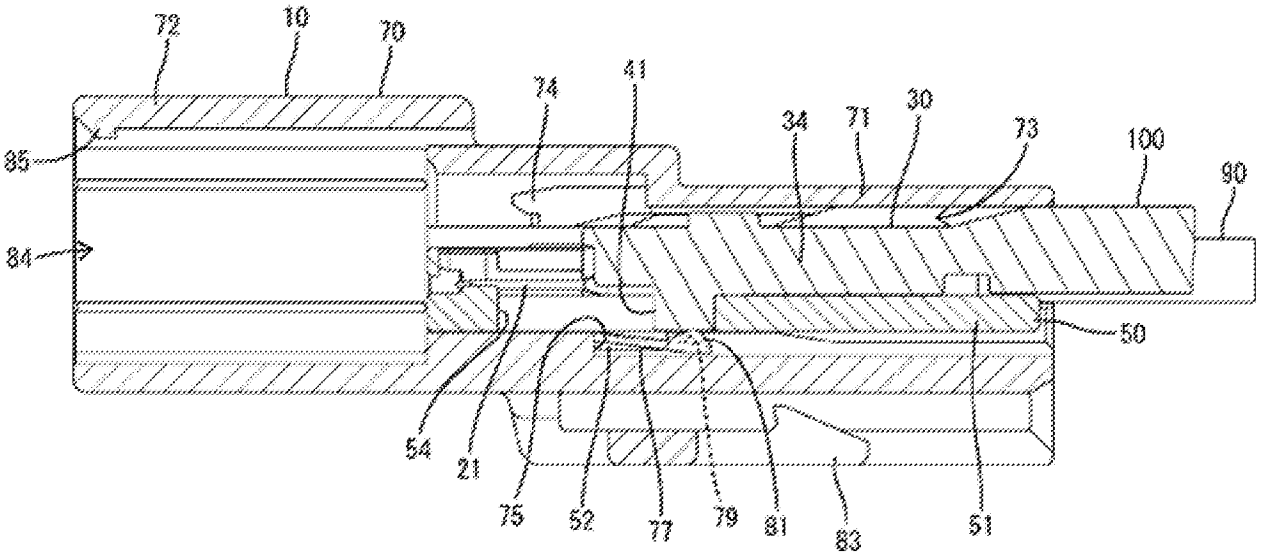
FIG. 1 is a side view in section showing a state where a unit composed of a terminal supporting body and a terminal covering body is inserted in an accommodating portion of a housing and the terminal covering body is arranged at a protection position in a connector according to one embodiment of the invention.
Figure 2:
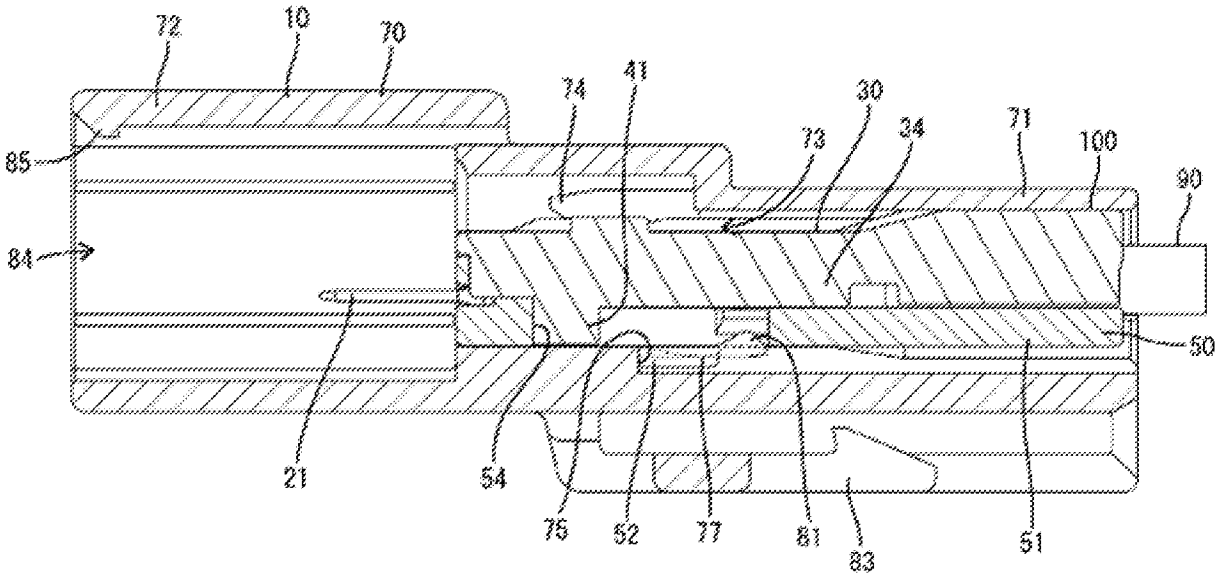
FIG. 2 is a section showing a state where the terminal covering body is displaced to an exposed position.

An embodiment is described on the basis of FIGS. 1 to 16. A connector 10 according to this embodiment is for in-vehicle communication and includes, as shown in FIG. 4, male terminal fittings 20, a terminal supporting body 30, a terminal covering body 50 and a housing 70. The male terminal fittings 20 are supported in the terminal supporting body 30. The terminal supporting body 30 and the terminal covering body 50 are assembled relatively slidably in a front-rear direction. The assembled terminal supporting body 30 and terminal covering body 50 are inserted into the housing 70 and accommodated along the front-rear direction. The structure of each member is described below.

Figure 5:
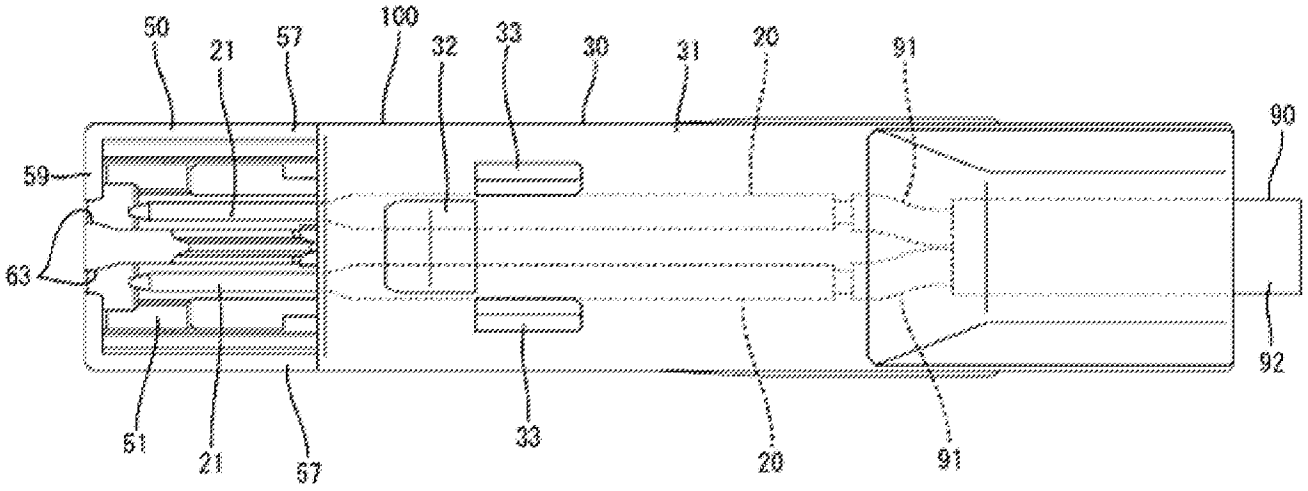
FIG. 5 is a plan view of the unit in which the terminal covering body is arranged at the protection position.

The male terminal fitting 20 is formed integrally, such as by bending a conductive metal material. The male terminal fitting 20 includes an elongated male tab 21 projecting forward from a tubular body, and a rear area of the body is connected to an end part of a cable 90, as shown in FIG. 5. The cable 90 is a twisted pair cable in which two wires 91 are twisted. The two wires 91 are untwisted in a part where a coating 92 is removed, and the male terminal fittings 20 are connected electrically and mechanically to the untwisted part.

Next, the terminal supporting body 30 and the terminal covering body 50 are described. Note that a vertical direction in the description is based on a state of FIGS. 1 to 4 where the terminal supporting body 30 and the terminal covering body 50 are accommodated in the housing 70.

Figure 8:
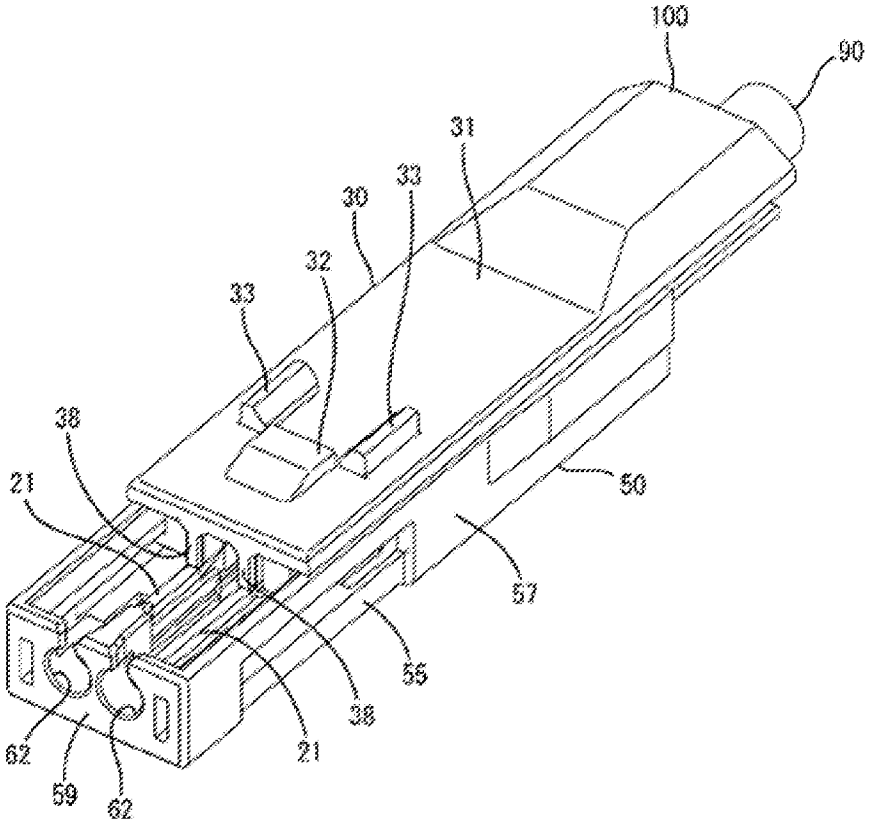
FIG. 8 is a perspective view of the unit in which the terminal covering body is arranged at the protection position.
Figure 9:
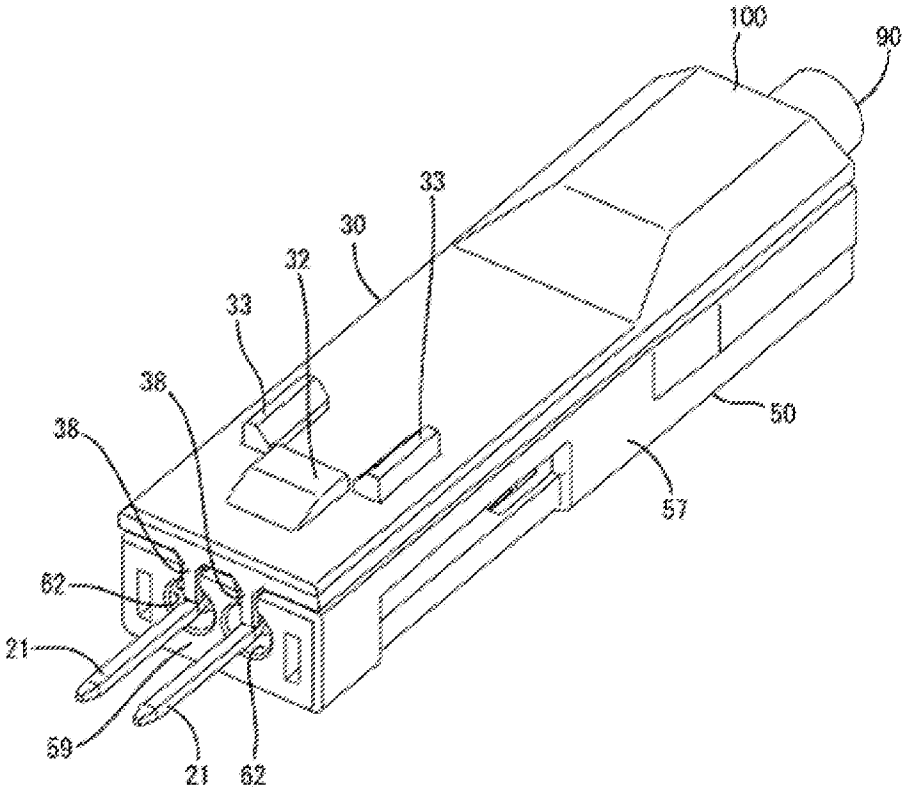
FIG. 9 is a perspective view of the unit in which the terminal covering body is arranged at the exposed position.
Figure 11:
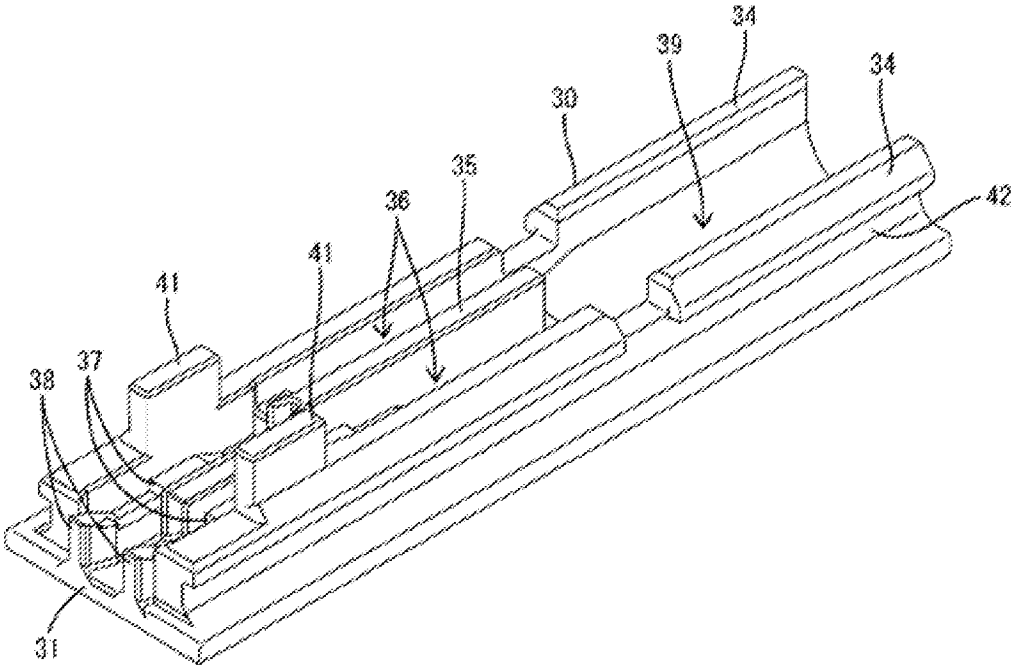
FIG. 11 is a perspective view of the terminal supporting body.

The terminal supporting body 30 is a dielectric made of synthetic resin and includes, as shown in FIG. 11, a support 31 in the form of a rectangular plate long in the front-rear direction. As shown in FIG. 8, a housing lock 32 projects on a front part of the upper surface of the support 31, and forward movement restricting portions 33 project at left and right sides of the terminal supporting body 30 at positions behind the housing lock 32.

As shown in FIG. 11, two rails 34 extend in the front-rear direction on both left and right end parts of the lower surface of the support 31, and a partition 35 to extends in the front-rear direction in a laterally central part. Left and right insertion spaces 36 are defined in the terminal supporting body 30 by the rails 34, the partition 35 and the support 31. The male terminal fittings 20 are inserted and accommodated in the respective terminal insertion spaces 36 of the terminal supporting body 30. Terminal retaining portions 37 project on the lower surface of the support 31 for retaining the male terminal fittings 20 accommodated into the respective terminal insertion spaces 36. Additionally, supporting pieces 38 are formed on the lower surface of the support 31 for supporting the male tabs 21 of the male terminal fittings 20 accommodated into the respective terminal insertion spaces 36.

The support 31 and the rails 34 form a cable end insertion space 39 behind the partition 35. An end part of the coating 92 of the cable 90 is accommodated into the cable end insertion space 39 in the terminal supporting body 30. Since the respective terminal insertion spaces 36 are located immediately in front of the cable end insertion space 39, a length of the untwisted part from the end part of the coating 92 of the cable 90 to a connected part to the male terminal fittings 20 becomes shorter and communication performance can be improved. Note that the male terminal fittings 20 inserted into the respective terminal insertion spaces 36 are fixed in the terminal supporting body 30 and behave integrally with the terminal supporting body 30.

Two rectangular plate-shaped restricting portions 41 project down on lower end front parts of the respective rails 34. Further, guide grooves 42 having a recessed cross-section extend in the front-rear direction in outer left and right surfaces of the respective rails 34.

Figure 6:
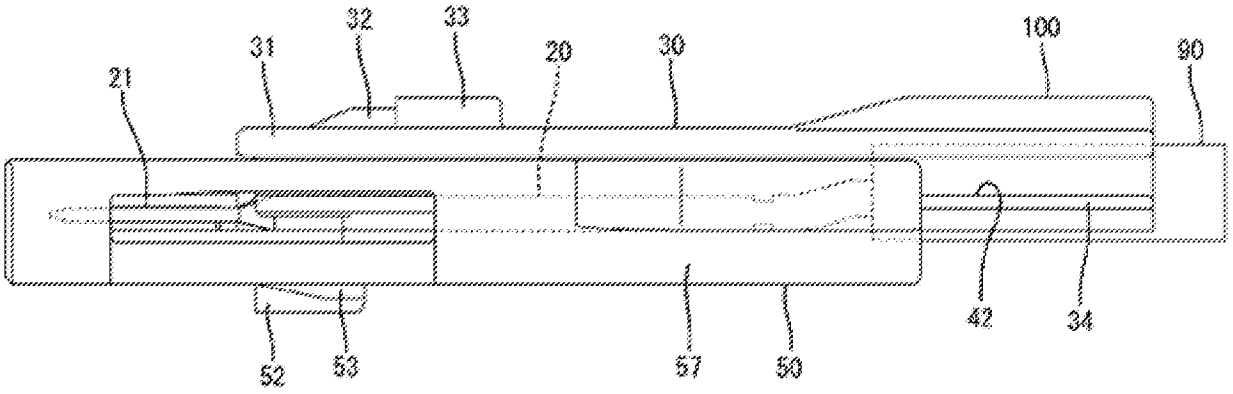
FIG. 6 is a side view of the unit in which the terminal covering body is arranged at the protection position.
Figure 7:
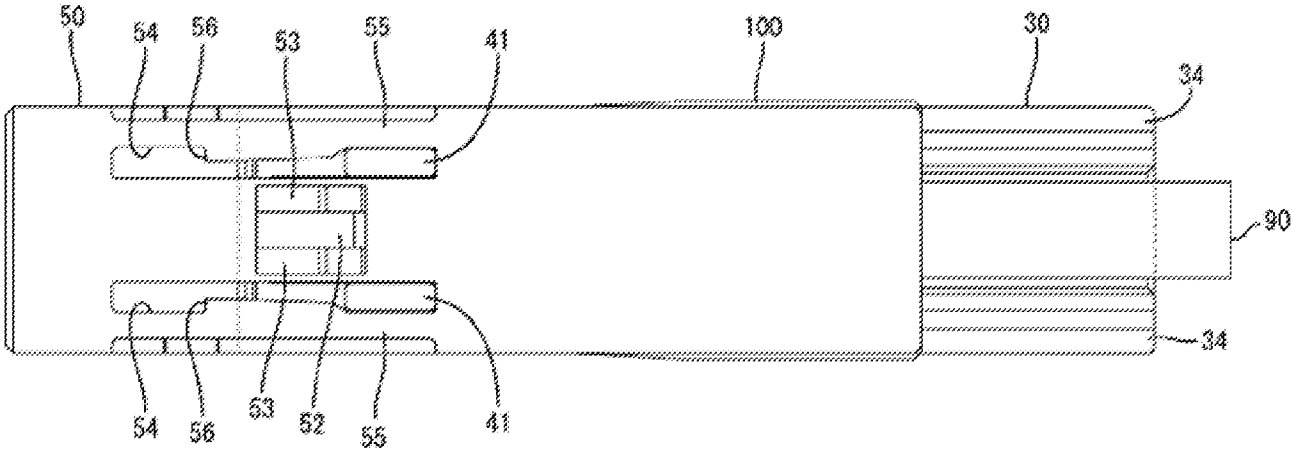
FIG. 7 is a bottom view of the unit in which the terminal covering body is arranged at the protection position.
Figure 10:
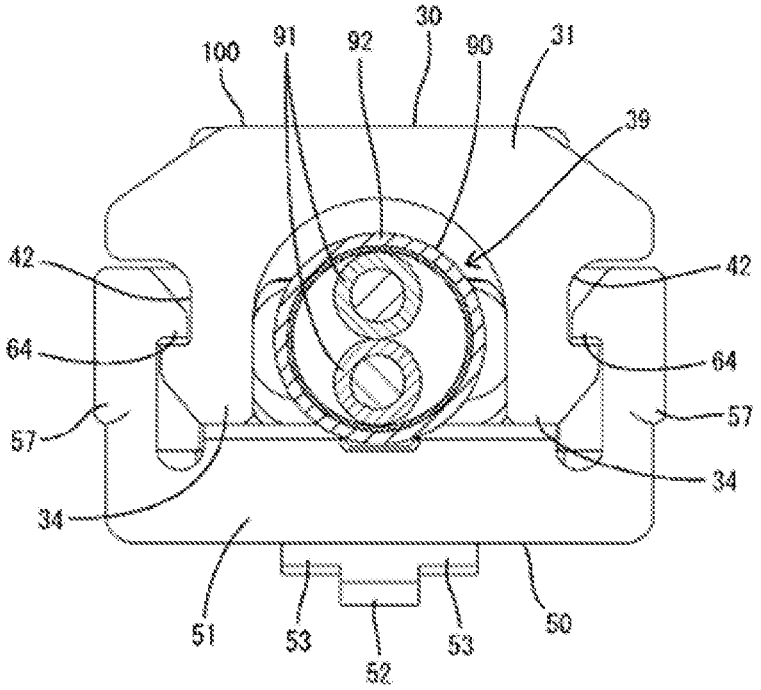
FIG. 10 is a back view of the unit in which the terminal covering body is arranged at the exposed position.
Figure 12:
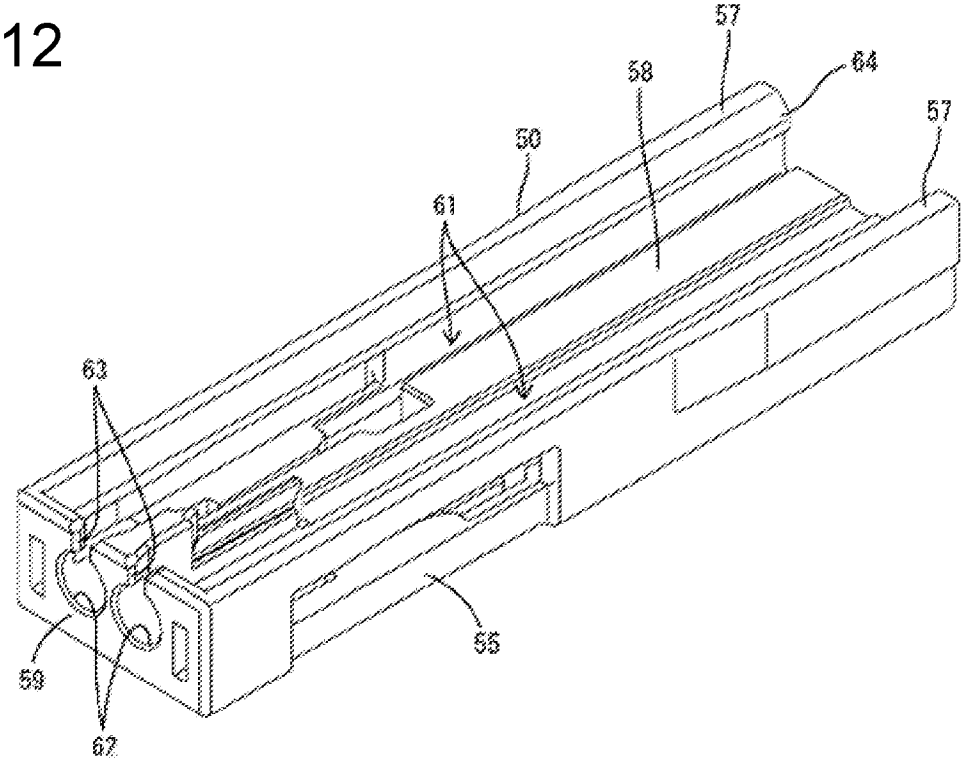
FIG. 12 is a perspective view of the terminal covering body.
Figure 14:
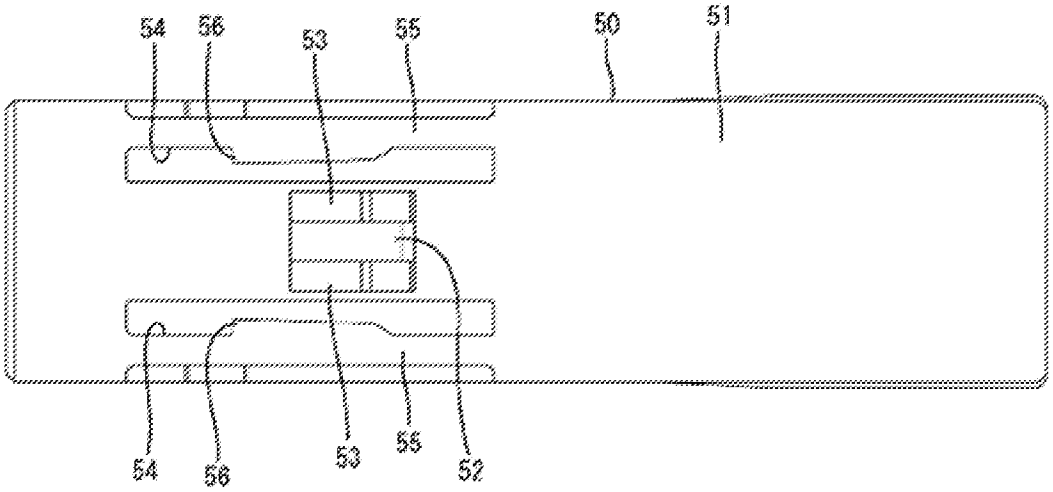
FIG. 14 is a bottom view of the terminal covering body.

The terminal covering body 50 is a dielectric made of synthetic resin and includes, as shown in FIG. 12, a rectangular plate-shaped cover 51 that is long in the front-rear direction. As shown in FIGS. 10 and 14, a contact 52 projects at laterally central part of the lower surface of the cover 51. The contact 52 is a rectangular block long in the front-rear direction, and a rear end corner is chamfered. Further, hooks 53 project respectively on left and right sides of the contact 52 on the lower surface of the cover 51. The hooks 53 are connected to left and right end surfaces of the contact 52 in a stepped manner to be slightly lower than the contact 52. As shown in FIG. 6, the front surface of each hook 53 is inclined rearward and the rear surface thereof is arranged substantially upright in the vertical direction.

As shown in FIG. 14, through grooves 54 are open in both left and right end parts of the cover 51. Each through groove 54 is in the form of a slit elongated in the front-rear direction. Left and right outer ends of the respective through grooves 54 are defined by semi-locking portions 55 in the cover 51. Each semi-locking portion 55 is a beam supported on both ends and elongated in the front-rear direction, and includes an interfering portion 56 protruding to narrow a groove width of the through groove 54 in a central part in an extending direction. Each semi-locking portion 55 is deflected and deformed outward in an arched manner to allow a relative displacement of the restricting portion 41 in the through groove 54 when the restricting portion 41 interferes with the interfering portion 56, as described later.

Figure 13:
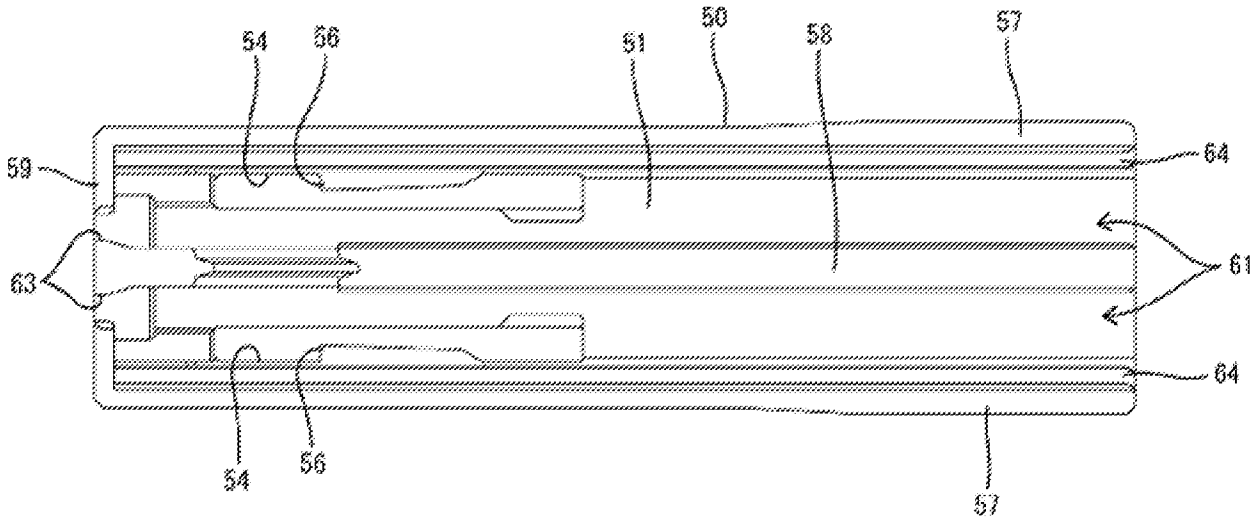
FIG. 13 is a plan view of the terminal covering body.

As shown in FIGS. 12 and 13, two side walls 57 extend in the front-rear direction on both left and right end parts of the upper surface of the cover 51, a separation wall 58 extends in the front-rear direction in a laterally central part, and a front wall 59 extends in a lateral direction on a front end part. The front wall 59 is connected to the front ends of the side walls 57 and the separation wall 58

The respective side walls 57 are cut in parts corresponding to the respective semi-locking portions 55 and are located outwardly of the respective semi-locking portions 55 in the lateral direction. The semi-locking portions 55 can be deflected and deformed into spaces retracted inward of the outer surfaces of the side walls 57. Guides 64 project inward on upper end parts of the respective side walls 57. As shown in FIG. 10, the guides 64 can enter the guide grooves 42 and slide in the guide grooves 42, thereby making the terminal supporting body 30 and the terminal covering body 50 relatively slidable.

As shown in FIG. 12, left and right covering spaces 61 are defined by the respective side walls 57, the separation wall 58, the front wall 59 and the cover 51 in the terminal covering body 50. The male terminal fitting 20 is arranged to be covered in each covering space 61. Left and right tab insertion openings 62 are open in the front wall 59 and the male tabs 21 of the male terminal fittings 20 can pass therethrough. Vertically aligned slit grooves 63 are open in the upper end of the front wall 59 and communicate with the respective tab insertion openings 62. Each slit groove 63 serves as a passage when the male tab 21 is introduced into each tab insertion opening 62 and each supporting piece 38 of the terminal supporting body 30 enters the slit groove 63, as shown in FIG. 4.

Figure 15:
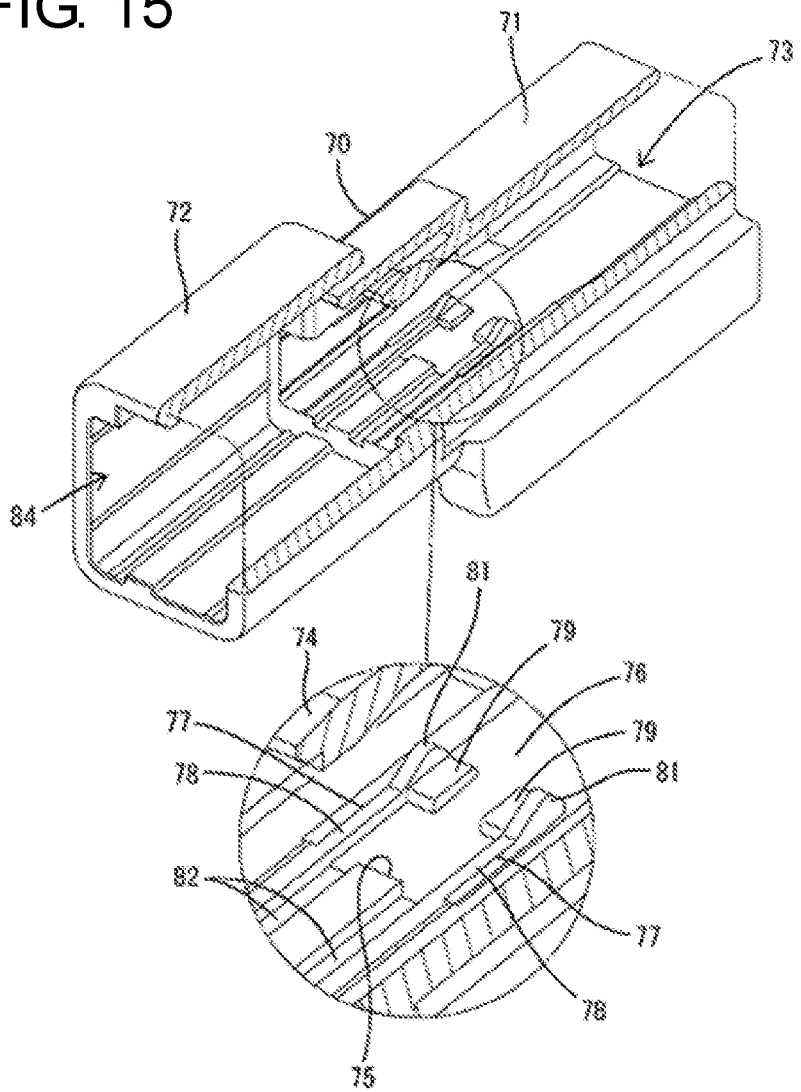
FIG. 15 is a perspective view partly in section of a housing.
Figure 16:
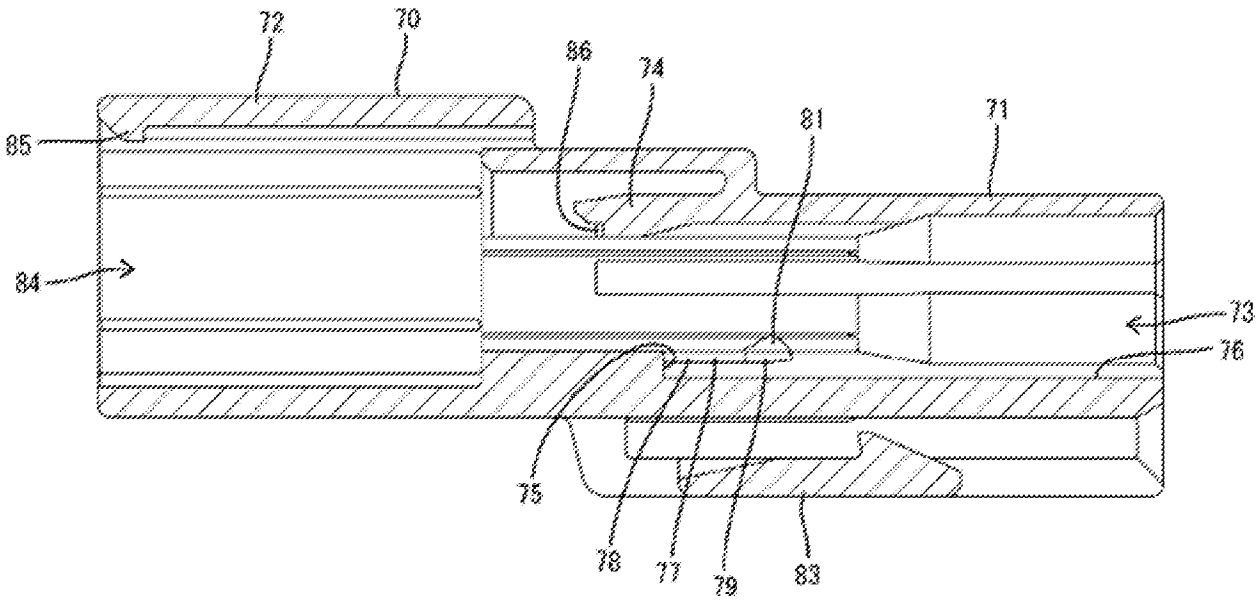
FIG. 16 is a section of the housing.

Next, the housing 70 is described. The housing 70 is made of synthetic resin and, as shown in FIGS. 15 and 16, has a tubular shape penetrating in the front-rear direction. The housing 70 includes an accommodating portion 71 and a receptacle 72. The receptacle 72 is connected to the accommodating portion 71 and projects forward.

The accommodating portion 71 has an accommodation space 73 penetrating in the front-rear direction. A deflectable and deformable locking lance 74 is cantilevered forward on an inner wall upper surface of the accommodating portion 71 (inner wall upper surface of the accommodation space 73). A front end part of the locking lance 74 is in the form of a claw projecting downward. A contact stop 75 in the form of a step is provided in a laterally central part of an inner wall lower surface of the accommodating portion 71, and an admission groove 76 is provided behind the contact stop portion 75. The admission groove 76 is dropper slightly and has a recessed cross-section. The contact stop 75 is a vertical wall surface.

The admission groove 76 extends in the front-rear direction in an inner wall lower surface of the accommodation space 73 and is open in the rear end of the accommodating portion 71, and the contact 52 and the hooks 53 of the terminal covering body 50 can enter the admission groove 76.

As shown in FIG. 15, hooking portions 77 are provided on both left and right sides of the admission groove 76 on the inner wall lower surface of the accommodating portion 71. Each hooking portion 77 is composed of an arm 78 cantilevered rearward from the contact stop 75, a hooking body 79 in the form of a rectangular plate projecting in from a rear part (tip part, free end part) of the arm 78 to narrow a groove width of the admission groove 76, and a chevron-shaped resistance portion 81 projecting up (toward the accommodation space 73) from the rear end of the arm 78 while having the same width as the arm 78. The arm 78 is deflectable and deformable with a base end coupled to the contact stop portion 75 substantially as a fulcrum. Two mold removal grooves 82 formed by the passage of a mold for molding the respective hooking bodies 79 extend in the front-rear direction in front areas of the inner wall upper surface of the accommodating portion 71 across the contact stop 75. As shown in FIG. 16, an attaching portion 83 is provided on a lower surface of the accommodating portion 71 and is to be attached to an unillustrated vehicle-side bracket.

The receptacle 72 is shorter in the front-rear direction than and radially one size larger than the accommodating portion 71, and has a fitting space 84 penetrating in the front-rear direction and communicating with the accommodation space 73. A claw-like lock 85 projects down on a front end part of an upper wall inner surface of the receptacle 72. An unillustrated mating female connector is fit into the fitting space 84 of the receptacle 72, and an unillustrated lock arm on the female connector resiliently locks the lock 85 to hold the connectors in a connected state.

Next, an assembling method and functions of the connector 10 of this embodiment are described.

In assembling, the male terminal fittings 20 are accommodated and held in the respective terminal insertion spaces 36 of the terminal supporting body 30. Subsequently, the terminal covering body 50 is mounted on the terminal supporting body 30. The guides 64 of the side walls 57 of the terminal covering body 50 resiliently enter the guide grooves 42 of the respective rails 34 of the terminal supporting body 30 so that the terminal supporting body 30 and the terminal covering body 50 are held in a separation restricted state (see FIG. 10). Further, the restricting portions 41 of the terminal supporting body 30 enter rear parts of the respective through grooves 54 of the terminal covering body 50, and the restricting portions 41 are arranged in a movement restricted state in the front-rear direction between the respective through grooves 54 and the respective interfering portions 56 (see FIG. 7). At this time, the male tabs 21 of the male terminal fittings 20 project forward of the terminal supporting body 30, but have the lower parts, both side parts and front parts thereof covered by the covering body 51, the side walls 57 and the front wall 59 in the terminal covering body 50 (see FIG. 8). In this way, the terminal covering body 50 is kept at a protection position for protecting the male tabs 21 with respect to the terminal supporting body 30. When the terminal covering body 50 is at the protection position, the male tabs 21 of the male terminal fittings 20 are kept protected from external matter.

Subsequently, the terminal supporting body 30 and the terminal covering body 50 assembled as described above (hereinafter, referred to as a unit 100) are inserted into the accommodation space 73 of the accommodating portion 71 of the housing 70 from behind. At this time, the unit 100 is pushed into the accommodation space 73 while the cable 90 extending rearward from the terminal supporting body 30 is gripped. The male tabs 21 of the male terminal fittings 20 are covered by the terminal covering body 50 at the protection position. Thus, the wall surface of the housing 70 does not directly interfere with the respective male tabs 21, thereby preventing fracture or breakage of the male tabs 21.

The contact 52 of the terminal covering body 50 contacts the contact stop 75 of the housing 70, as shown in FIG. 1, to define a properly inserted position of the terminal covering body 50 in the accommodation space 73 of the housing 70 with further forward movement stopped. At this time, a rear part of the terminal supporting body 30 is exposed behind the housing 70. Further, the restricting portions 41 of the terminal supporting body 30 contact the resistance portions 81 of the respective hooks 77 to deflect and deform the respective hooks 77.

The cable 90 continues to be pushed, and that pushing force becomes a force of a certain magnitude or higher mainly composed of a locking force between the restricting portions 41 and the respective interfering portions 56 and exceeding friction resistance acting on the unit 100. Thus, the terminal supporting body 30 starts sliding with respect to the terminal covering body 50. The restricting portions 41 separate from the respective resistance portions 81 when the terminal supporting body 30 starts sliding, thereby canceling a deflected state of the hooks 77. Accordingly, and a sliding speed of the terminal supporting body 30 accelerates due to inertia. Further, the sliding of the terminal supporting body 30 displaces the restricting portions 41 toward front parts of the respective through grooves 54 and the restricting portions 41 press the respective interfering portions 56 so that the semi-locking portions 55 resiliently deflect and deform.

When the terminal supporting body 30 reaches a properly inserted position in the accommodation space 73 of the housing 70, the restricting portions 41 move to front parts of the respective through grooves 54, the semi-locking portions 55 resiliently return, and the restricting portions 41 are arranged between the through grooves 54 and the respective interfering portions 56 in a movement restricted state in the front-rear direction. In this way, relative sliding of the terminal supporting body 30 and the terminal covering body 50 is restricted, and the entire unit 100 is inserted in the accommodation space 73 (see FIG. 2). Further, the male tabs 21 of the male terminal fittings 20 project into the receptacle 72 from the respective tab insertion openings 62 and the terminal covering body 50 is held at an exposed position for exposing the male tabs 21 with respect to the terminal supporting body 30.

Further, in the relatively sliding process of the terminal supporting body 30, the housing lock 32 of the terminal supporting body 30 presses, deflects and deforms the locking lance 74. However, as the terminal supporting body 30 becomes inserted properly into the accommodation space 73, the locking lance 74 resiliently returns and is locked to the housing lock 32 from behind. In this way, the terminal supporting body 30 or, eventually, the unit 100 is retained and accommodated in the accommodation space 73 of the housing 70. Further, the forward movement restricting portions 33 of the terminal supporting body 30 contact stoppers 86 (see FIG. 16) in the accommodating portion 71 to restrict movement of the terminal supporting body 30 toward the receptacle 72.

Thereafter, the unillustrated mating female connector is fit into the fitting space 84 of the receptacle 72. When the connectors are connected properly, the male tabs 21 projecting into the fitting space 84 of the receptacle 72 are inserted into boxes of unillustrated mating female terminal fittings and the male and female terminal fittings are connected electrically.

The unit 100 may have to be taken out from the accommodation space 73 of the housing 70 for maintenance or other reason. This removal is achieved by using a tool to deflect the locking lance 74 in a direction to unlock the housing lock 32, and, in that state, the cable 90 is pulled rearward. Then, the respective hooked portions 53 of the terminal covering body 50 interfere with the hooking bodies 79 of the respective hooks 77, and that interference resistance exceeds the locking force between the restricting portions 41 and the respective interfering portions 56 caused by the pulling of the cable 90. Thus, the restricting portions 41 and the respective interfering portions 56 are unlocked from each other and the restricting portions 41 are displaced toward rear parts of the respective through grooves 54. In the process of pulling the cable 90 in this way, the terminal supporting body 30 and the terminal covering body 50 relatively slide and the terminal covering body 50 is displaced automaticall from the exposed position to the protection position.

Figure 3:
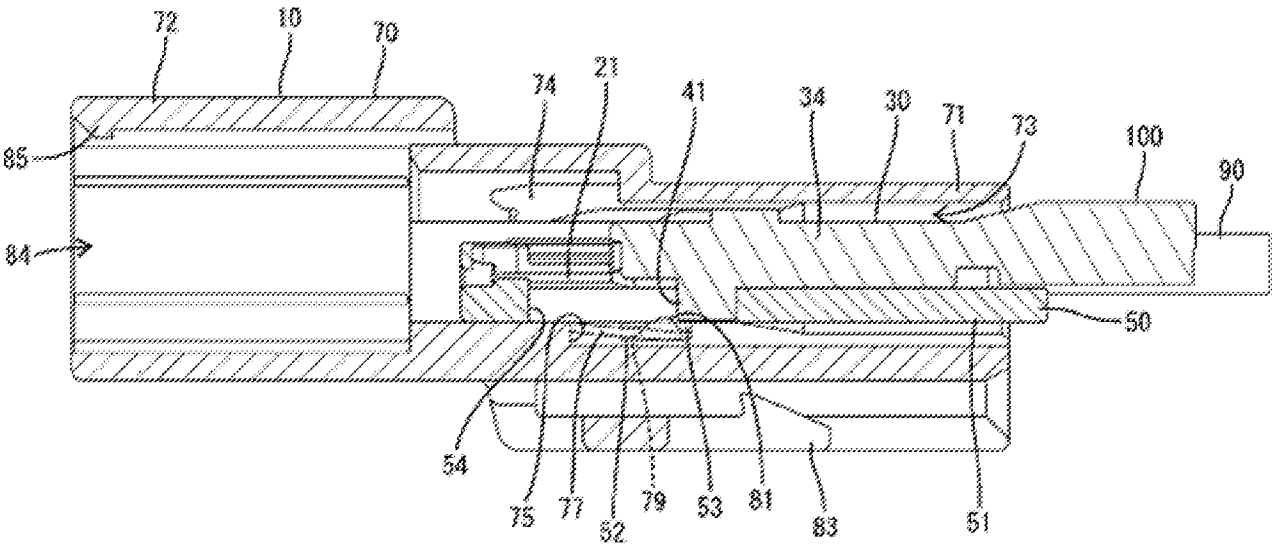
FIG. 3 is a section showing a state where the terminal covering body is displaced back to the protection position in the process of taking out the unit from the accommodating portions.
Figure 4:
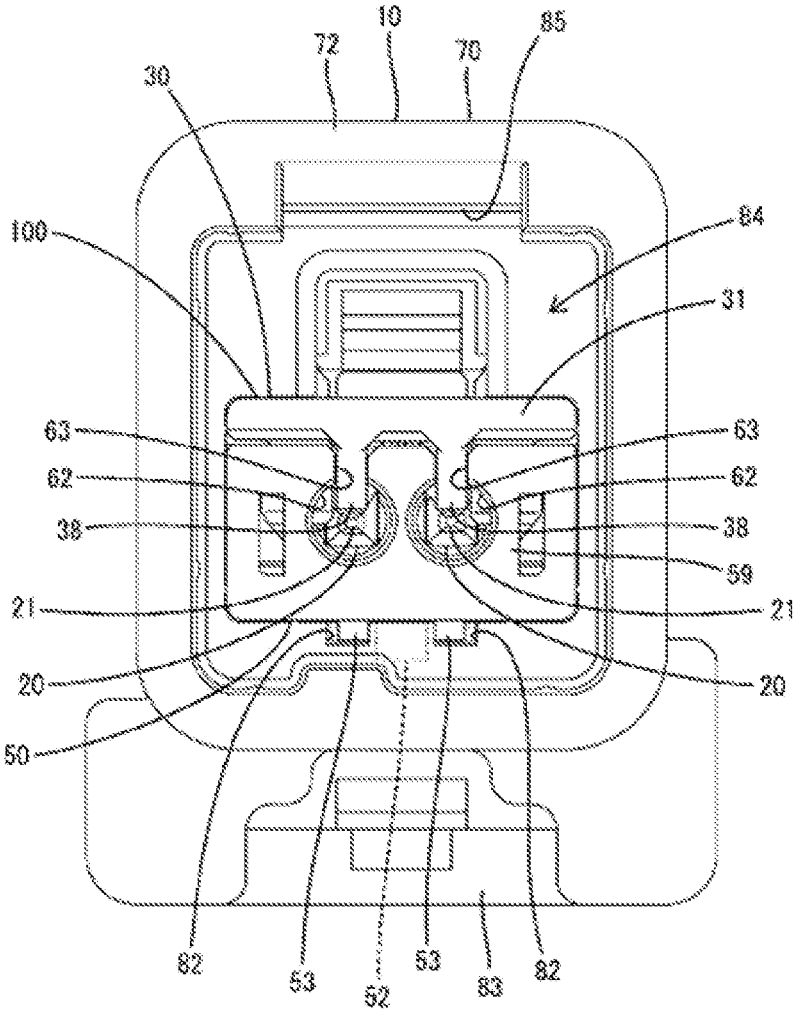
FIG. 4 is a front view showing a state where the unit is properly accommodated in the accommodating portion.

When the cable 90 further continues to be pulled, the hooking portions 77 are pressed by the respective hooked portions 53 to be deflected and deformed, and a receding displacement of the terminal covering body 50 in the accommodation space 73 is allowed (see FIG. 3). Thereafter, when the unit 100 is taken out from the housing 70, the terminal covering body 50 is at the protection position and protects the male tabs 21.

As described above, according to this embodiment, when a force of the certain magnitude or higher is applied to the terminal supporting body 30 with the unit 100 inserted in the accommodation space 73 of the accommodating portion 71 and the terminal covering body 50 at the protection position stopped in contact with the contact stop portion 75, the terminal supporting body 30 relatively slides, the terminal covering body 50 is displaced to the exposed position and the male tabs 21 are exposed to the fitting space 84 of the receptacle 72. Thus, the male tabs 21 are electrically connectable to the mating female terminal fittings. Here, in a state before the unit 100 is accommodated into the accommodating portion 71, the male tabs 21 are protected by the terminal covering body 50 at the protection position and avoid fracture or breakage.

As described above, an operation of sliding the terminal supporting body 30 and the terminal covering body 50 is linked with an operation of accommodating the terminal supporting body 30 and the terminal covering body 50 into the accommodating portion 71, and the terminal covering body 50 can be displaced automatically to the exposed position. Thus, a special tool for displacing the terminal covering body 50 to the exposed position is unnecessary, working man-hours are not increased and assembling efficiency can be improved.

Further, the terminal covering body 50 is formed with the deflectable and deformable semi-locking portions 55, and the terminal supporting body 30 is provided with the restricting portions 41 configured to be locked resiliently to the semi-locking portions 55 at the protection position and restrict a relative displacement of the terminal covering body 50 to the exposed position unless the force of the certain magnitude or higher is applied to the terminal supporting body 30. Thus, the terminal covering body 50 can be prevented from being easily displaced to the exposed position in the state before the unit 100 is accommodated into the accommodating portion 71.

Further, the accommodating portion 71 of the housing 70 is provided with the deflectable and deformable locking lance 74 configured to retain and lock the properly accommodated terminal supporting body 30. Thus, the terminal supporting body 30 cannot escape from the accommodating portion 71. Particularly, the male terminal fittings 20 are supported in the terminal supporting body 30 and are locked by the locking lance 74. Thus, a pulling force applied to the cable 90 that is connected to the male terminal fittings 20 is resisted.

Further, the accommodating portion 71 is provided with the hooks 77 that are configured to resiliently contact the terminal covering body 50 in a withdrawing direction so that the terminal covering body 50 can be slid to the protection position. The terminal covering body 50 that is displaced to the protection position can be taken out when a force in the withdrawing direction is applied to the terminal supporting body 30 so that the terminal supporting body 30 escapes rearward. The terminal covering body 50 is displaced automatically to the protection position when the unit 100 is taken out from the housing 70. Thus, it is not necessary to perform a separate operation of returning the terminal covering body 50 to the protection position to protect the respective male tabs 21 after the unit 100 is taken out from the housing 70, and work efficiency can be improved.

Other embodiments are briefly described below.

In the above embodiment, the terminal supporting body is arranged on an upper side and the terminal covering body is arranged on a lower side with respect to the housing. Conversely, the terminal supporting body may be arranged on the lower side and the terminal covering body may be arranged on the upper side. Further, the terminal supporting body and the terminal covering body may be arranged on both left and right sides of the housing.

In the above embodiment, the terminal covering body is provided with the semi-locking portions and the terminal supporting body is provided with the restricting portions. Conversely, the terminal supporting body may be provided with the semi-locking portions and the terminal covering body may be provided with the restricting portions.

In the above embodiment, the hooks are deflectable in the accommodating portion and the hooked portions are fixed to the terminal covering body. Conversely, the hooks may be fixed to the accommodating portion and the hooked portions may be deflectable in the terminal covering body.

The contact stop may be provided on an opening edge part of the accommodation space in the rear surface of the accommodating portion, and the rear end part of the terminal covering body may be stopped in contact with the opening edge part (contact stop portion) on the rear surface of the accommodating portion.

The deflectable locking lance provided in the accommodating portion may retain and lock at least one of the terminal supporting body and the terminal covering body and does not necessarily retain and lock the terminal supporting body.

Any special lock structure such as the semi-locking portions may not be provided between the terminal supporting body and the terminal covering body and relative sliding of the both bodies may be temporarily restricted only by frictional resistance.

LIST OF REFERENCE SIGNS

10 . . . connector
20 . . . male terminal fitting
21 . . . male tab
30 . . . terminal supporting body
41 . . . restricting portion
50 . . . terminal covering body
55 . . . semi-locking portion
70 . . . housing
71 . . . accommodating portion
72 . . . receptacle
74 . . . locking lance
75 . . . contact stop
77 . . . hook
90 . . . cable

The invention claimed is:

1. A connector, comprising:

a terminal supporting body and a terminal covering body slidable relative to each other;

a male terminal fitting supported in the terminal supporting body, the male terminal fitting including a projecting male tab; and a housing including an accommodating portion internally provided with an accommodation space capable of accommodating the terminal supporting body and the terminal covering body and a receptacle connected to the accommodating portion, configured to surround the male tab and internally provided with a fitting space, a mating female connector being fittable into the fitting space:

wherein:

the terminal covering body is relatively slidable between a protection position for covering the male tab and an exposed position for exposing the male tab and includes a plate-like covering body capable of covering the male terminal fitting;

a contact portion is provided on a plate surface of the covering body;

a contact stop portion configured such that the properly accommodated terminal covering body is stopped in contact therewith the contact portion is provided on an inner surface of the accommodating portion; and the terminal supporting body relatively slides to displace the terminal covering body to the exposed position, is accommodated properly in the accommodating portion and locates the male tab in the receptacle when a force of a certain magnitude or higher is applied with the terminal covering body at the protection position stopped in contact with the contact stop portion; and wherein one of the terminal supporting body and the terminal covering body is provided with a deflectable and deformable semi-locking portion, and the other is provided with a restricting portion configured to be resiliently locked to the semi-locking portion at the protection position and to restrict a relative displacement of the terminal covering body to the exposed position unless the force of the certain magnitude or higher is applied to the terminal supporting body.

2. A connector, comprising:

a terminal supporting body and a terminal covering body slidable relative to each other;

a male terminal fitting supported in the terminal supporting body, the male terminal fitting including a projecting male tab; and a housing including an accommodating portion configured to accommodate the terminal supporting body and the terminal covering body and a receptacle connected to the accommodating portion and configured to surround the male tab;

wherein:

the terminal covering body is relatively slidable between a protection position for covering the male tab and an exposed position for exposing the male tab;

the accommodating portion is provided with a contact stop portion configured such that the properly accommodated terminal covering body is stopped in contact therewith;

the terminal supporting body relatively slides to displace the terminal covering body to the exposed position, is properly accommodated in the accommodating portion and locates the male tab in the receptacle when a force of a certain magnitude or higher is applied with the terminal covering body at the protection position stopped in contact with the contact stop portion; and the accommodating portion is provided with a hook configured to resiliently contact the terminal covering body in a withdrawing direction, relatively slide the terminal covering body to the protection position and allow the terminal covering body displaced to the protection position to be taken out when a force is applied to the terminal supporting body in the withdrawing direction; and wherein one of the terminal supporting body and the terminal covering body is provided with a deflectable and deformable semi-locking portion, and the other is provided with a restricting portion configured to be resiliently locked to the semi-locking portion at the protection position and to restrict a relative displacement of the terminal covering body to the exposed position unless the force of the certain magnitude or higher is applied to the terminal supporting body.

3. The connector of claim 2, wherein the accommodating portion is provided with a deflectable and deformable locking lance configured to retain and lock the properly accommodated terminal supporting body.

4. The connector of claim 1, wherein the accommodating portion is provided with a deflectable and deformable locking lance configured to retain and lock the properly accommodated terminal supporting body.

* * * * *